US010637147B2

(12) United States Patent
Oh et al.

(10) Patent No.: US 10,637,147 B2
(45) Date of Patent: Apr. 28, 2020

(54) WIDEBAND ANTENNAS

(71) Applicant: HEWLETT-PACKARD DEVELOPMENT COMPANY, L.P., Houston, TX (US)

(72) Inventors: Sung Oh, Palo Alto, CA (US); Philip Wright, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 58 days.

(21) Appl. No.: 15/747,216

(22) PCT Filed: Sep. 29, 2015

(86) PCT No.: PCT/US2015/052958

§ 371 (c)(1),
(2) Date: Jan. 24, 2018

(87) PCT Pub. No.: WO2017/058176

PCT Pub. Date: Apr. 6, 2017

(65) Prior Publication Data

US 2018/0219294 A1 Aug. 2, 2018

(51) Int. Cl.

| | |
|---|---|
| ***H01Q 9/42*** | (2006.01) |
| ***H01Q 5/378*** | (2015.01) |
| *H01Q 1/24* | (2006.01) |

(52) U.S. Cl.
CPC ..... *H01Q 9/42* (2013.01); *H01Q 5/378* (2015.01); *H01Q 1/243* (2013.01)

(58) Field of Classification Search
CPC ..... H01Q 9/42; H01Q 5/378; H01Q 1/243
(Continued)

(56) References Cited

U.S. PATENT DOCUMENTS 6,380,895 B1 4/2002 Moren et al.
7,825,863 B2 * 11/2010 Martiskainen ..... H01Q 1/243 343/700 MS (Continued)

FOREIGN PATENT DOCUMENTS

CN 102683798 A 9/2012
KR 10-2010-0018910 A 2/2010

(Continued)

OTHER PUBLICATIONS

Fang-Hsien Chu and Kin-Lu Wong, "Internal Handset Antenna Integrated with USB Connector for WWAN/LTE Operation," 2011, pp. 1-4.

(Continued)

*Primary Examiner* — Hai V Tran
(74) *Attorney, Agent, or Firm* — HP Inc. Patent Department

(57) ABSTRACT

Examples described herein include examples of an antenna that includes a planar conductive body disposed in a first plane, a signal source connection disposed on the planar conductive body, a direct feed antenna arm coupled to the signal source connection and disposed in a second plane parallel to the first plane, a coupled antenna arm disposed in the second plane and in proximity to a portion of the direct feed antenna arm, and a conductive interconnect element coupled to a region of the planar conductive body disposed in the first plane and the coupled antenna arm disposed in the second plane.

15 Claims, 7 Drawing Sheets

(58) Field of Classification Search
USPC ..... 343/833
See application file for complete search history.

(56) References Cited

U.S. PATENT DOCUMENTS

| | | | | |
|---|---|---|---|---|
| 2004/0215958 | A1* | 10/2004 | Ellis | H04W 4/80 713/155 |
| 2008/0180330 | A1 | 7/2008 | Wei-Shan | |
| 2012/0019415 | A1 | 1/2012 | Tseng | |
| 2012/0188141 | A1 | 7/2012 | Islam | |
| 2013/0044030 | A1* | 2/2013 | Oh | H01Q 1/243 343/700 MS |
| 2013/0207861 | A1 | 8/2013 | Huang et al. | |
| 2013/0225234 | A1 | 8/2013 | Cheng et al. | |
| 2014/0253398 | A1 | 9/2014 | Hsieh et al. | |
| 2014/0361948 | A1 | 12/2014 | Tanaka et al. | |
| 2015/0123874 | A1 | 5/2015 | Chan et al. | |
| 2015/0207228 | A1* | 7/2015 | Oh | H01Q 5/35 343/702 |
| 2015/0295314 | A1* | 10/2015 | Oh | H01Q 1/243 343/866 |

FOREIGN PATENT DOCUMENTS

| | | | |
|---|---|---|---|
| WO | WO-2014/064490 | A1 | 5/2014 |
| WO | WO-2015020244 | A1 | 2/2015 |

OTHER PUBLICATIONS

Hongkoo Lee et el., "A New Radiation Method for Ground Radiation Antenna," Oct. 23-25, 2013, pp. 1-3.
Kin-Lu Wong and Yu-Wei Chang, "Internal WWAN/LTE Handset Antenna Integrated with USB Connector," May 2012, pp. 1-2, Wiley Periodicals, Inc.

* cited by examiner

WIDEBAND ANTENNAS

BACKGROUND

Many types of mobile computing devices use wireless communication protocols to transmit and receive electronic signals corresponding to voice and data. The transmission or reception of various wireless electronic signals involve the use of various corresponding types of antennas. The directivity, efficiency, and frequency ranges of such antennas are often constrained by the limitations placed on the size, volume, and dimensions of the device in which the antennas are implemented. The trend for smaller and thinner mobile computing devices, such as tablets, smart phones, laptops, and the like, introduce additional complexity in antenna design for use in such devices,

DETAILED DESCRIPTION

Figure 1:
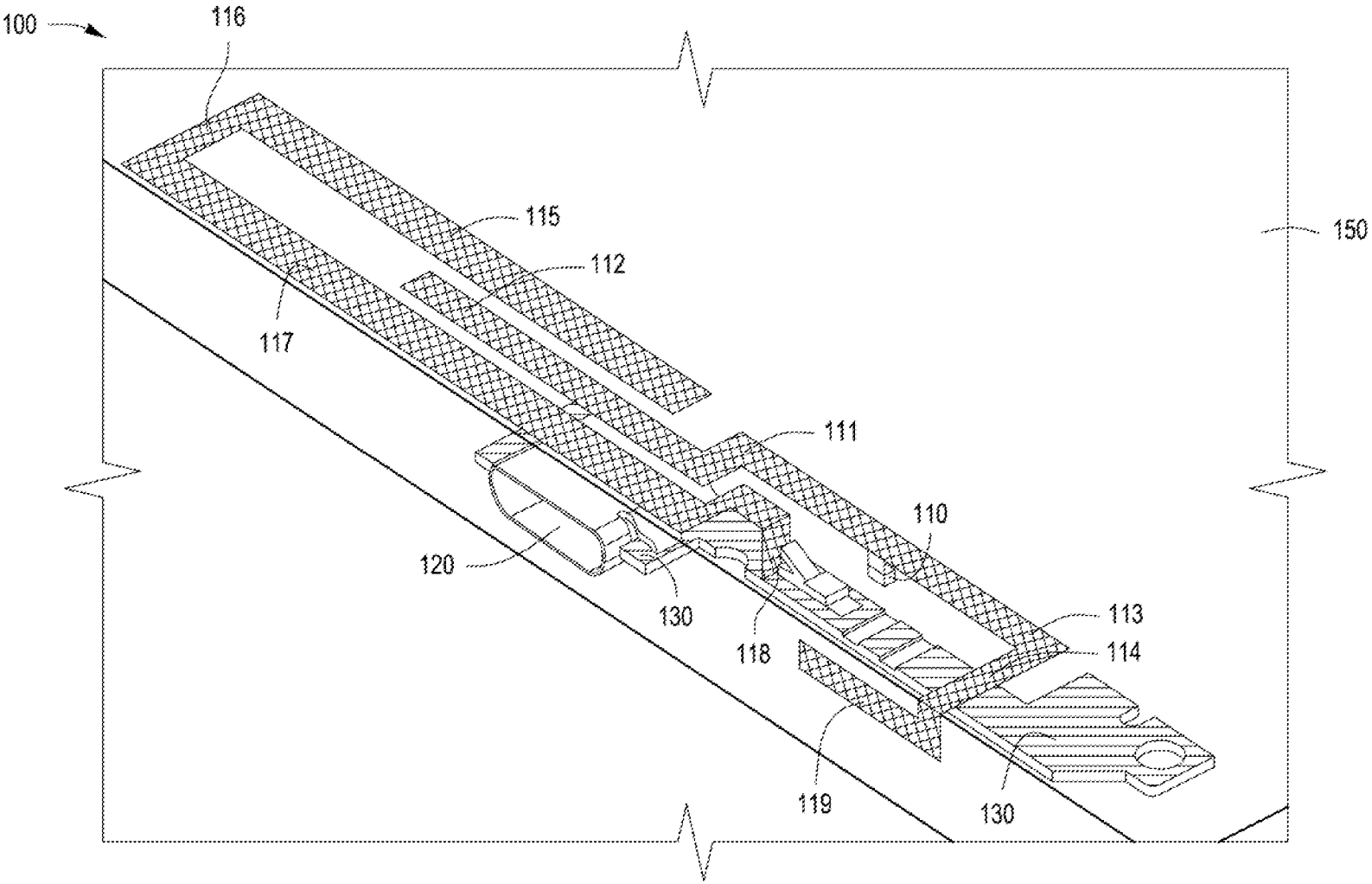
FIG. 1 illustrates a perspective view of an example wideband antenna with an integrated data port.

Example implementations of the present disclosure include wideband antennas with integrated data ports, computing devices that use wideband antennas with integrated data ports, and example methods for creating and using the same. For example, implementations of the present disclosure include wideband antennas that integrated universal serial bus SB) port assemblies that can be used in size and volume constrained enclosures and electronics associated with mobile computing devices, Mobile computing devices, such as smart phones, tablet computers, small form factor desktop computers, pocket computers, and the like, can offer useful portability. To increase the usefulness, many such mobile computing devices include components and functionality for connecting to local and wide area networks. For example, contemporary mobile computing devices include capabilities for wireless voice and/or data communications using various types of local and wide area wireless communication protocols. For the sake of portability, mobile computing devices are often housed in small form factors that can limit the size of the components, such as antennas, used for wireless communications.

The antennas used by mobile computing devices can be used to generate wireless signals defined by a wireless communication protocol. A wireless communication protocol can define various frequency bands. The frequency bands can be defined by specifications for a number of frequency bands and their corresponding widths (e.g., ranges of frequencies for each band). Using the frequency bands and signal protocols, a mobile computing device can communicate with a network another computing devices on the network.

However, due to the fundamental gain-bandwidth limitation of antennas constrained by limited dimensions of every shrinking mobile computing devices, the wireless communication performance of some mobile computing devices can be limited by a reduction in size. One challenge associated with the design of mobile computing devices with small form factors is related to the limited performance of a multiband antenna for communication using long term evolution (LTE) types of wireless data communication. For example, smart phones, tablet computers, and other types of mobile computing devices can include an LTE wideband and/or multiband antenna at the bottom of the device near the microphone, speaker, data port, and other components, so that it extends away from a user and other components located in the main body of the mobile computing device. In small form factor devices, the presence of the other components in the limited volume in which the antenna is located can potentially limit the radiation performance of the antennas.

Example implementations of the present disclosure include antenna structures that can include portions or regions of the printed circuit board (PCB) or flexible printed circuit (FPC) and achieve high radiation performance. As such, various components coupled to the PCB or FPC of the mobile computing device cart make up part of the radiation structure without sacrificing performance.

In one example implementation, an antenna structure an include a direct feed arm disposed on one side of an insulating structure that is driven by a signal source connection disposed on the other side of the insulating structure. One example direct feed antenna can include an excitation antenna arm portion and a monopole antenna arm portion. The excitation antenna arm can be disposed in proximity to a coupled antenna arm portion.

The coupled antenna can include elements disposed on both sides of the insulating structure. As such, first portion of the coupled antenna arm can be disposed next to the excitation antenna arm of the direct feed arm on a first side of the insulating structure, and a second portion of the coupled antenna arm can be disposed on the'second side of the insulating structure on which the source signal connection a located. The first portion and the second portion of the coupled antenna arm can be coupled to one another by interconnect disposed to traverse the insulating structure from the first side to the second side. In such implementations, the second portion of the coupled antenna arm can include a region of conductor on the second side of the PCB and/or any components disposed thereon. For example, the coupled antenna arm can include a trace of conductor disposed on the first side of the insulating structure, and a region of conductor on the second side of the insulating structure and any mobile computing device components, such as a USB port, a microphone, accelerometer, and the like, coupled thereto. Various aspects of the present disclosure are described below in reference to specific examples depicted in the accompanying figures. It should be noted that the examples described herein are illustrative only and are not intended to limit the scope of the disclosure or the claims.

FIG. 1 depicts a perspective view of art example wideband ante structure 100 implemented in a mobile computing device (partially depicted). As shown, the wideband antenna structure 100 can be disposed in a region of the mobile computing device that can include other components. For example, the region of the mobile computing device in which the wideband antenna structure 100 is disposed can include a region of PCB 130 that extends into a portion of the housing away from elements in the main body of the mobile computing device, such as the metal chassis 150, the processor, memory, display device, etc. In the example shown, the wideband antenna structure 100 can include multiple antenna elements disposed in various orientations relative to one another and disposed in multiple planes, In one example implementation, one element of the wideband antenna structure 100 can include a source signal connection 110. In such implementations, the source signal connection 110 can be coupled to a processor, or other signal generating element in the mobile computing device, by a connection formed on a PCB in the mobile device. As such, the signal source connection 110 can couple the processor, or other signal generating element, to elements of the wideband antenna structure 100. In particular, the signal source connector 110 can couple one signal source in a first plane (e.g., on PCB 130) to a direct feed antenna arm 111 disposed in second plane, In various examples described herein, the first plane can be defined by a first side of a PCB and the second plane can be defined by a second side of a PCB. In various implementations, a PCB, or FPC, in a mobile device can be a structure that includes one or more planar conductive bodies disposed on a structural support or insulating element. For example, a PCB can include a rigid insulating layer that provides structure to a layer of metal on one side and a layer of metal on the other that can be etched, milled, or otherwise processed to create conductive traces to connect other electronic components disposed thereon. As such, the PCB, or similar structure, can include two layers of conductors that sandwich a layer f insulating material. While reference is made to a PCB, other structures are possible. For example, the wideband antenna structure 100 can be built around a volume of insulating material that supports various elements and/or separates individual PCBs that include other electronic components.

As used herein, the term "insulating material" can refer to any material with internal electric changes that do not flow freely. As such, an insulating material does not easily conduct electric current under the influence of an electric field of a magnitude used in computing devices. Example insulating materials that can be implemented in various examples of the present disclosure include, but are not limited to, glass, fiberglass reinforced plastic, resins, polymers, porcelain, plastics, paper, fiberboard, etc.

As further depicted in FIG. 1, the direct feed antenna arm 111 of the wideband antenna structure 100 can include multiple segments or elements. For example, as illustrated in FIG. 1, the direct feed antenna arm 111 can include a monopole antenna arm 113 and an excitation antenna arm 112.

The monopole antenna arm 113 can further include additional elements. As shown, the monopole antenna 113 can include an orthogonal antenna arm element 114 as well as a non-coplanar antenna arm element 119. The orthogonal antenna arm element 114 can be disposed in the same plane as the other elements e direct feed antenna arm 111 and extend in a direction perpendicular to a main antenna arm n of the monopole antenna arm 113. The non-coplanar antenna arm element 119 can be disposed in a plane that is perpendicular to or non-coplanar with the plane in which the main antenna arm portion of the monopole antenna arm 113 is disposed. For example, while the main antenna arm portion and the orthogonal antenna arm element 114 of the monopole antenna arm 113 an be disposed in a plane parallel to the top surface of the insulating material of the PCB, the non-coplanar antenna arm element 119 can be disposed in a plane perpendicular to the top surface of the insulating material of the PCB (e.g., the side edge of the PCB). As used herein the terms "parallel", "perpendicular", "coplanar", and "non-coplanar" refer to positioning and orientations that are substantially parallel, perpendicular, coplanar, and non-coplanar, respectively. As such, deviations from being absolutely parallel, perpendicular, coplanar, or non-coplanar are also contemplated by the present disclosure.

The wideband antenna structure 100 can also include elements that are capacitively coupled to the direct feed antenna arm 111 For example the wideband antenna structure 100 can include a coupled antenna arm. As shown, the coupled antenna arm can include elements in two planes. One element of the coupled antenna arm can include antenna elements 115, 116, and 117 disposed in proximity to the excitation antenna arm 112 in a plane parallel to the top surface of the PCB or insulating structure of the mobile device. Another element of the coupled antenna arm can include a region 130 of a PCB. As such, the region 130 of the PCB can be disposed in a plane parallel to the bottom side of the PCB or insulating structure disposed between the various elements of the coupled antenna arm. The non-coplanar elements of the coupled antenna arm can be coupled to one another by a conductive interconnect element 118 that traverses the insulating material from the plane containing the antenna elements 115, 116 and 117 to the plane containing the region 130 of the PCB.

As shown, the region 130 of the PCB may include other components of the mobile device, such as, a data port assembly 120 (e.g., a USB port assembly), a microphone, a light sensor, and the like. As such, the region 130 of the PCB and any components disposed thereon, including, but not limited to, data port assembly 120 can act as antenna elements of the wideband antenna structure 100.

Figure 2:
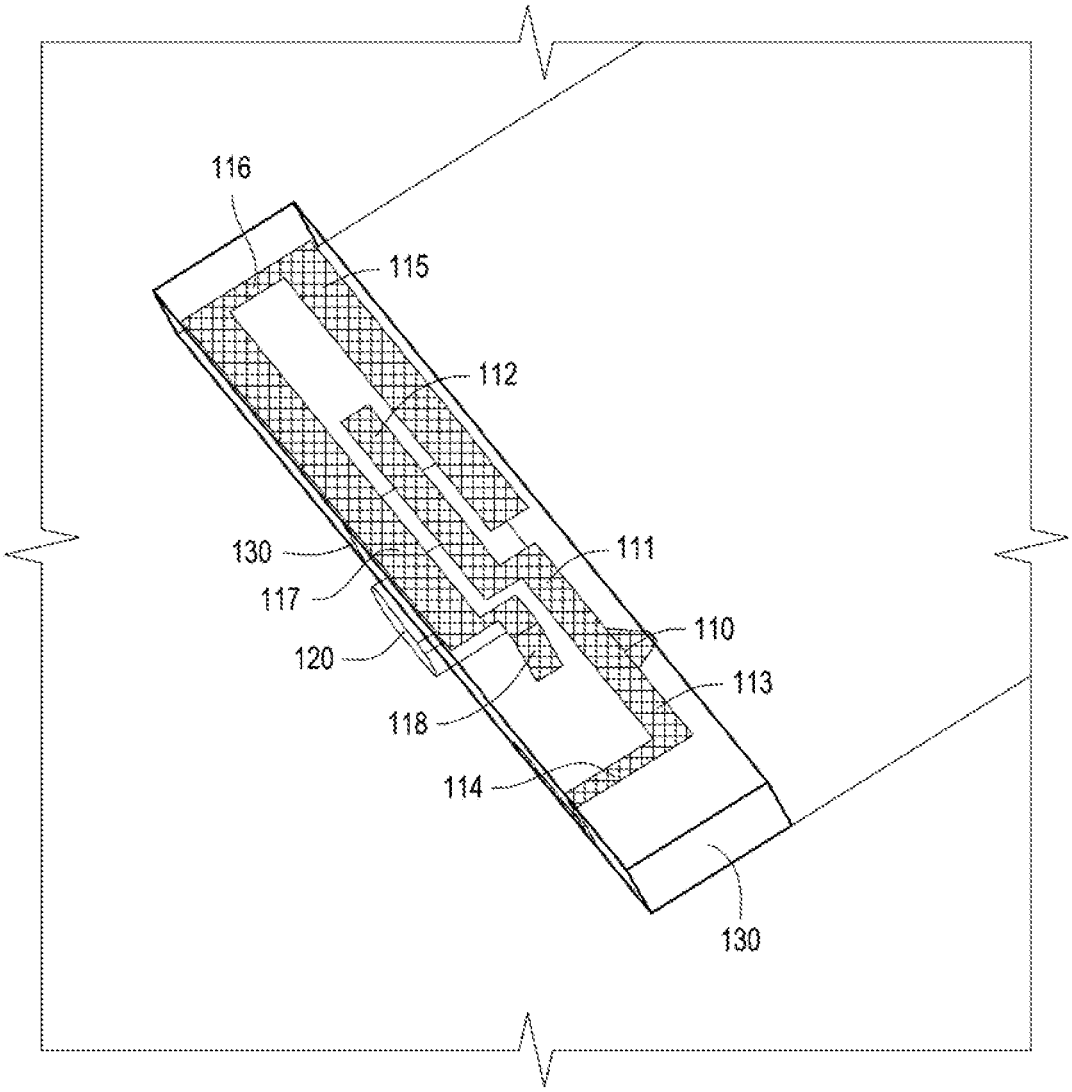
FIG. 2 depicts a top view of an example wideband antenna, with an, integrated data port.

FIG. 2 depicts a top view of a simplified schematic of an example wideband antenna structure. In particular, FIG. 2 depicts the antenna elements of the wideband antenna structure disposed in a plane parallel to the top surface of insulating material 140. The insulating material can include any thickness and configuration of insulating material disposed between the antenna elements e wideband antenna structure disposed on one side and the antenna of the wideband antenna structure disposed on the other side Each side of the insulating material 140 can define corresponding planes. In the particular example shown, the antenna elements 115, 116, and 117 of the coupled antenna arm are disposed in a plane parallel to the top surface of the insulating material 140. Similarly, the excitation antenna arm 112 and the monopole antenna arm 113, including orthogonal antenna arm element 114, of the direct feed antenna 111 can also be disposed in a plane parallel to the top surface of the insulating material 140. The antenna elements disposed in the plane parallel to the top surface of the insulating material 140 can be coupled to region 130 of a PCB disposed in a plane parallel to the bottom surface of the insulating material 140 by the conductive interconnect element 118. Accordingly, as shown, the antenna elements of the wideband antenna structure disposed on the top surface of the insulating material 140 can be disposed at least partially above components, such as the data port assembly 120, of the mobile computing device. As used herein, the terms "top" and "bottom" are used relatively in reference to the figures for brevity and clarity. No absolute positioning of the top and bottom of elements described herein is intended.

Figure 3:
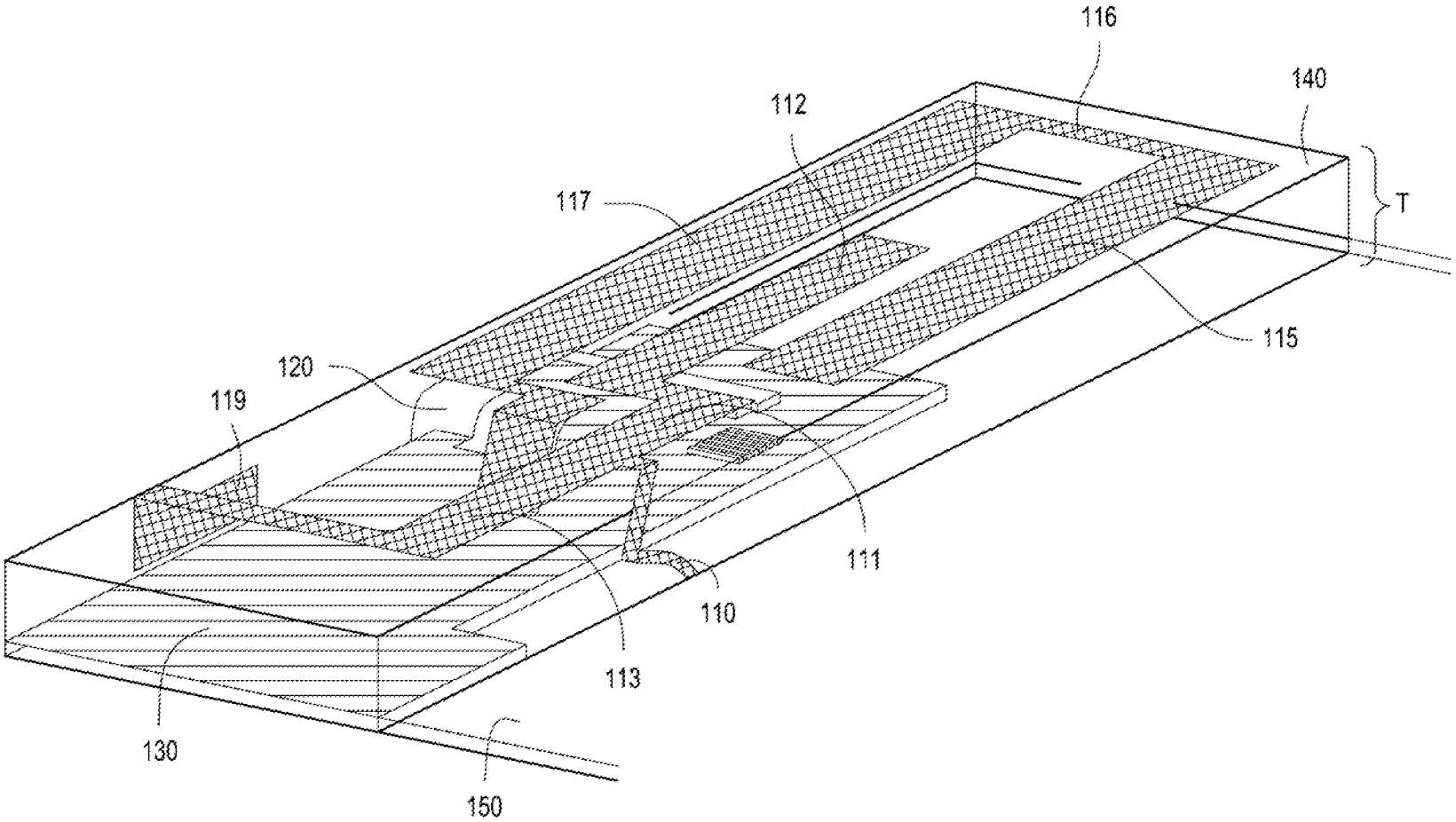
FIG. 3 depicts another perspective view of an example wideband antenna with an integrated data port.

FIG. 3 depicts another perspective view f a wideband antenna structure. The view of the wideband antenna structure in FIG. 3 depicts the volume of the insulating material 140 having a thickness T. Accordingly, the antenna elements of the wideband antenna structure disposed on the top surface of the insulating material 140 can be separated from the antenna elements of the wideband antenna structure, such as the PCB 130 and/or data port 120 by the thickness T.

In some implementations, the location of various components disposed on the PCB 130 can be located at a position between the bottom surface and the top surface of the insulating material 140. For example, all or part of the data port assembly 120 can be disposed between the bottom surface and the top surface of the insulating material 140. As also depicted, the insulating material 140 and/or the PCB 130 can be coupled to a structural element the mobile device. For example, the insulating material 140 and/ the PCB 130 can he coupled to a structural chassis, housing, or PCB of the mobile computing device.

Figure 4:
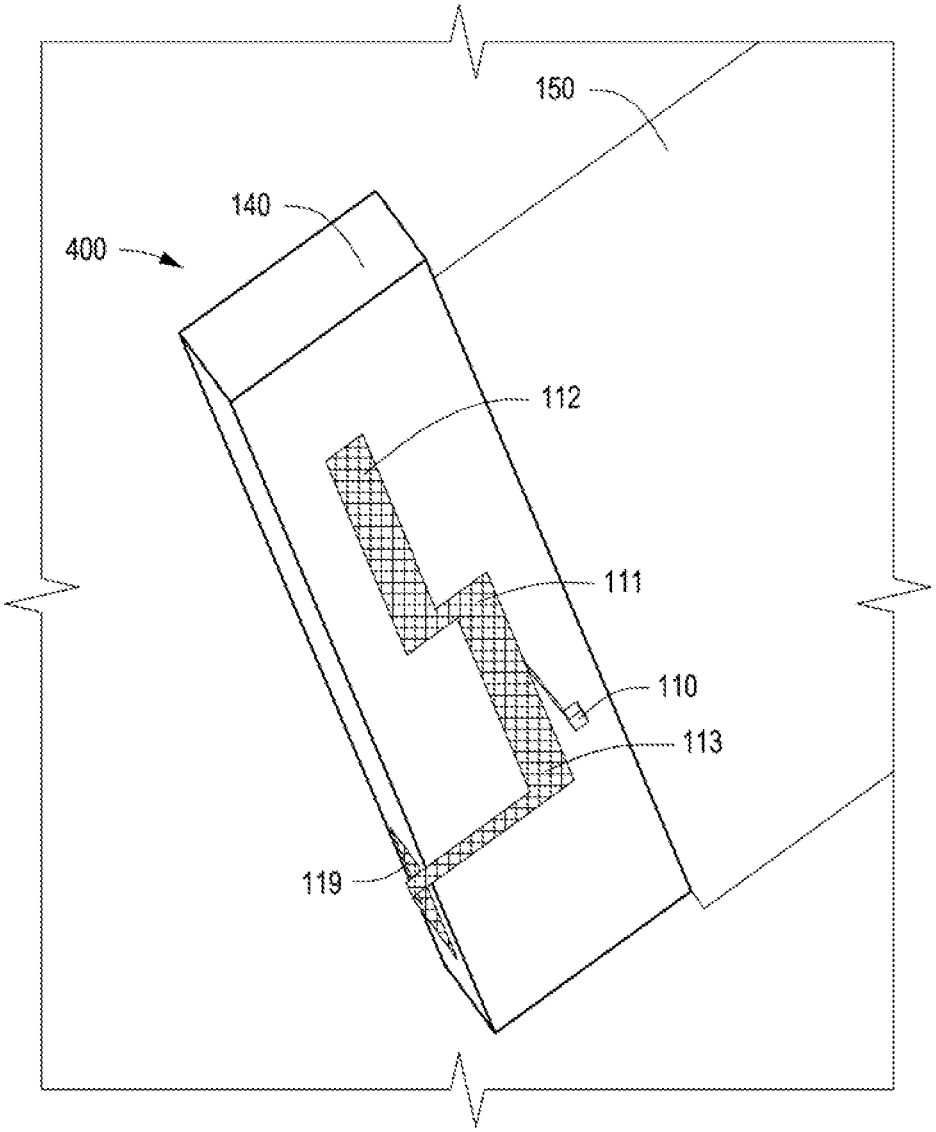
FIG. 4 illustrates an example direct feed antenna arm of a wideband antenna.

FIG. 4 depicts an example implementation 400 of a particular direct feed antenna 111. As shown, the direct feed antenna arm 111 can be coupled to an underlying PCB or other component of the mobile computing device by signal source connection 110 that traverses the thickness of the insulating material 140. As such, the direct feed antenna arm 111 can be excited directly by a signal applied to the signal source connection 110.

As shown, the direct feed antenna arm 111 can include an excitation antenna arm 112 and a monopole antenna arm 113. As described herein, the monopole antenna arm 113 can include an antenna element 119 disposed on the edge of the insulating material 140. In such implementations, the monopole antenna arm 113 can be excited to create high band frequency resonances. In contrast, the excitation antenna arm 112 can capacitively couple with the coupled antenna arm (not shown) to create multiple resonances for both low frequency and high frequency bands. The dimensions, position, orientation, and other physical specifications of the direct feed antenna arm 111 can be chosen to achieve the desired frequency resonances. For example, the dimensions of the excitation antenna arm 112 can he selected in view of the dimensions of antenna elements of the coupled antenna arm disposed in planes parallel to the top and/or bottom of the insulating material 140.

Figure 5:
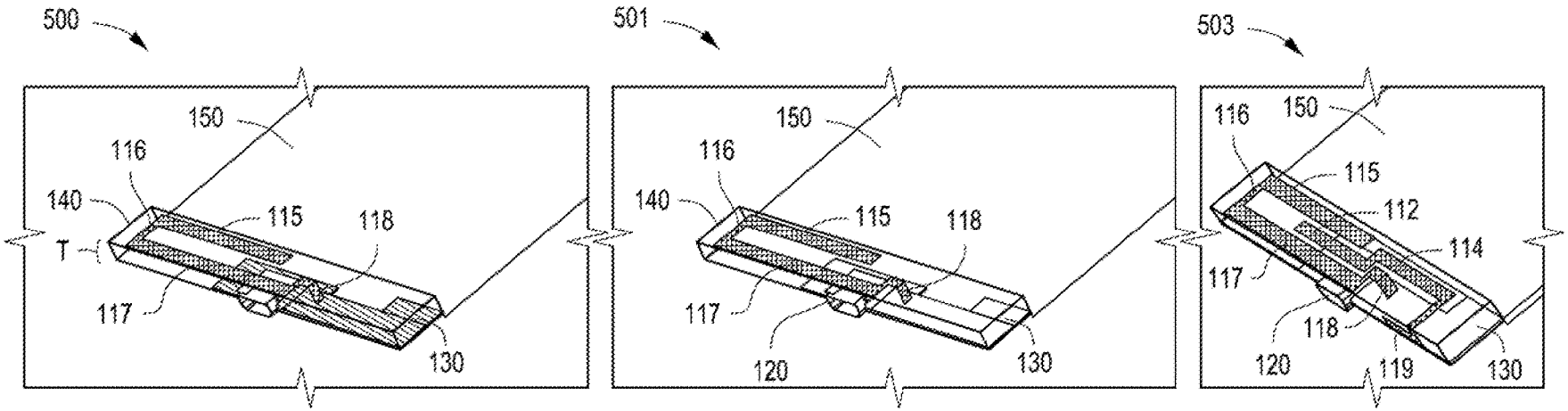
FIG. 5 illustrates an example coupled antenna arm of a wideband antenna.

FIG. 5 depicts views 500, 501, and 503 of an example coupled antenna arm. In view 500, depicts all elements of the coupled antenna arm disposed on the top and bottom of the insulating material 140. In particular, the antenna elements 115, 116, and 117 are shown disposed in a plane parallel to the top surface of insulating material 140 and the PCB 130 disposed in a plane parallel to the bottom surface of insulating material 140. The elements disposed on the top surface of the insulating material 140 and the elements disposed on the bottom of the insulating material 140 are shown as being coupled to one another by the conductive interconnect element 118. As shown, the conductive interconnect element 118 can traverse of the thickness T of the insulating material 140.

View 501 of FIG. 5 depicts the antenna elements 115, 116, and 117 disposed on the top surface of the insulating material 140 to highlight the placement relative to the PCB 130 and any components disposed thereon. In such implementations, the PCB 130 and the, data port 120 can be used as part of the radiating structure of the wideband antenna structure 100.

View 503 of FIG. 5 illustrates the PCB 130 and data port assembly 120 components of the coupled antenna arm on the bottom surface of the insulating material 140 and their positioning relative to the direct feed arm 111 and other components of the coupled antenna arm (e.g., 115, 116, and 117) disposed on the top surface of insulating material 140. In such implementations, the coupled antenna arm can be tightly coupled with the excitation antenna arm 112 to create wide multiband resonances for both low frequency and high frequency bands. The high frequency band bandwidth can be further expanded by resonances created by the monopole antenna arm 113 of the direct feed antenna arm 111.

In various implementations, the volume of the wideband antenna structure 100 can be defined by the dimensions of the insulating layer 140. Accordingly, the volume can be the product of the thickness T, the length, and the width of the insulating material 140. In some example implementations, the antenna volume of the wideband antenna structure 100 can be occupied by the PCB 130, data port 120, and other components, such as, a speaker, a vibrating element, flex connectors, screws, standoffs, and other structural and electronic components of the mobile computing device in which the antenna is included.

Implementations of the present disclosure carp include a mobile computing device having a wideband antenna structure 100 that uses regions of an underlying PCB, and electronic components disposed thereon, as elements of the radiating structure. As such, such implementations can overcome various radiation performance limitations the can be introduced by the inclusion of a data port assembly 120 or other electronic components included in the region or volume shared by the antenna. For example, many mobile computing devices, such as smartphones and tablets, may include a data port assembly, such as a USB port, in the same end of the device as the antenna. Implementations of the present disclosure can overcome the limitations of the presence of such connections can impose on the radiation performance of the antenna without increasing the volume defined by the elements of the antenna. Such implementation can address the performance limitations that may be introduced with a corresponding cable, such as USB cable, is coupled to the data port assembly 120.

Figure 6:
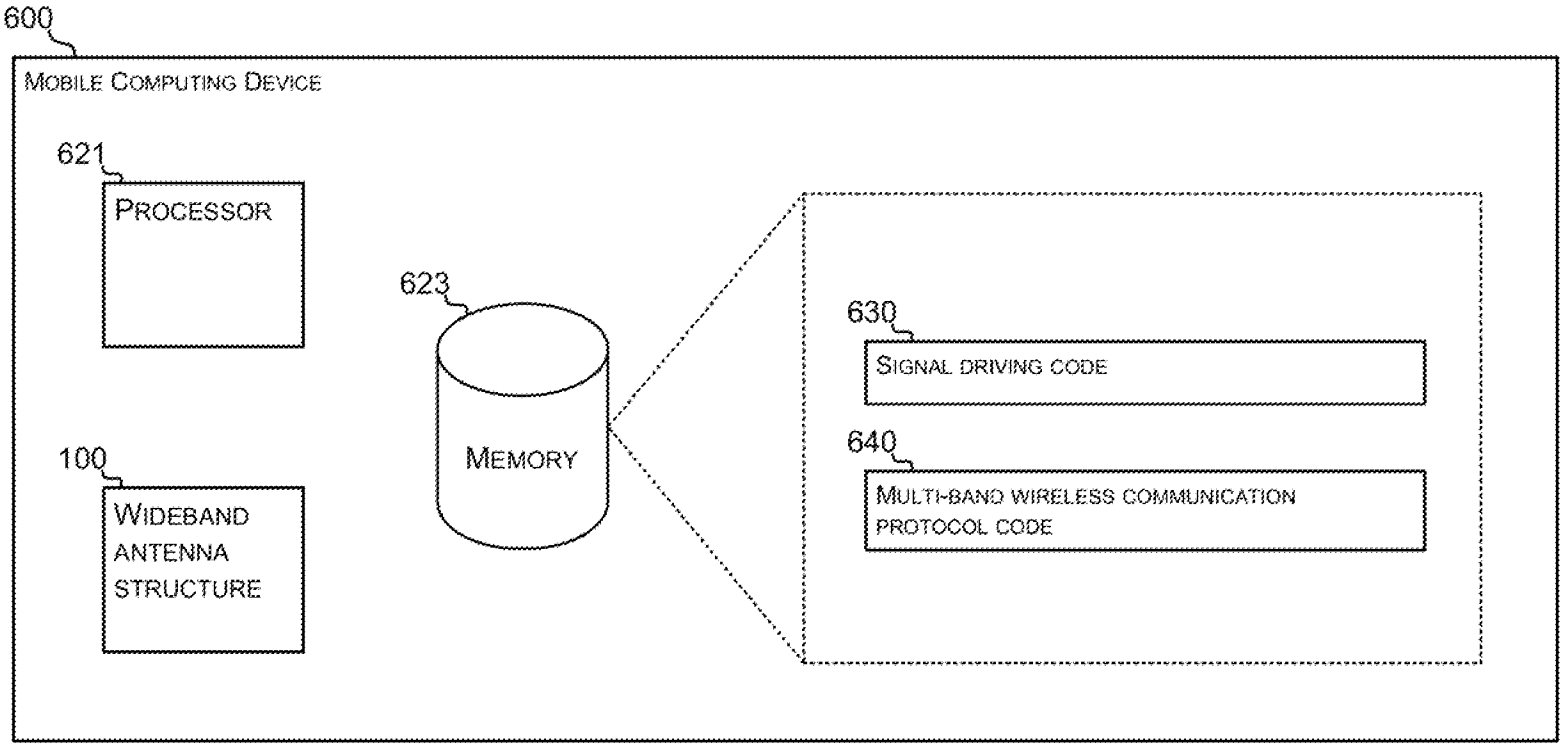
FIG. 6 illustrates an example mobile computing device quipped with a wideband antenna structure.

FIG. 6 depicts an example mobile computing device 600 in which various examples of the present disclosure can be implemented. As s n, the mobile computing device 600 can include a processor 621. The processor 621 can be coupled to a wideband antenna structure 100 and/or a memory 623. The memory 623 can include any combination of transitory and non-transitory computer readable media. As such, the memory 623 can include volatile and nonvolatile memory technologies for storing computer executable code for implementing or driving various examples of the present disclosure. In various examples, the computer executable code stored in the memory 623 can include instructions for performing various operations described herein.

For example, the processor 621 can execute signal driving code 630 that includes instructions for generating signals for driving the signal source connection 110 of the wideband antenna structure 100 as described herein. In various other examples, the processor 621 can execute the multi-band wireless communication protocol code 640 to modulates the signals for driving the signal source connection 110 to generate wireless communication signals using the wideband antenna structure 100. In related implementations, the processor 621 can execute executable code stored in the memory 623 to detect wireless communication signals received by or excited in the wideband antenna structure 100 to implement two-way data communications.

As described herein, examples of the present disclosure can be implemented as any combination of executable code and hardware. For example, implementations can include computer executable code executed by a processor 621 or mobile computing device 600 to cause resonances in the wideband antenna structure 100 to communicate according to a wireless communication protocol. As such, the functionality of processor 621 or mobile computing device 600 described herein can be implemented as executable code that includes instructions that when executed by the processor cause the processor to perform operations, or generate signals that cause other devices (e.g., components of the mobile computing device 600) to perform operations, in accordance with various implementations and example described herein.

For example, the functionality for driving signal source connection 110 can be implemented as executable signal driving code 630 stored in the memory 623 and executed by processor 621. Similarly, the functionality for modulating the drive signals to communicate wirelessly using a corresponding multi-band wireless communication protocol can be implemented as multi-band wireless communication protocol code 640 stored in memory 623 and executed in processor 621. As such, the executable code stored in the memory 623 can include instructions for operations that when executed by processor 621 cause the processor 621 to implement the functionality described in reference to FIG. 7 described below.

The processor 621 may be a microprocessor, a microcontroller, an application specific integrated circuit (ASIC), or the like. According to an example implementation, the processor 621 is a hardware component, such as a circuit.

The memory 623 can Include any type of transitory or non-transitory computer readable medium. For example the memory 623 include volatile or non-volatile memory, such as dynamic random access memory (DRAM), electrically erasable programmable read-only memory (EEPROM), magneto-resistive random access memory (MRAM), memristor, flash memory, floppy disk, a compact disc read only memory (CD-ROM), a digital video disc read only memory (DVD-ROM), or other optical or magnetic media, and the like, on which executable code may be stored.

Figure 7:
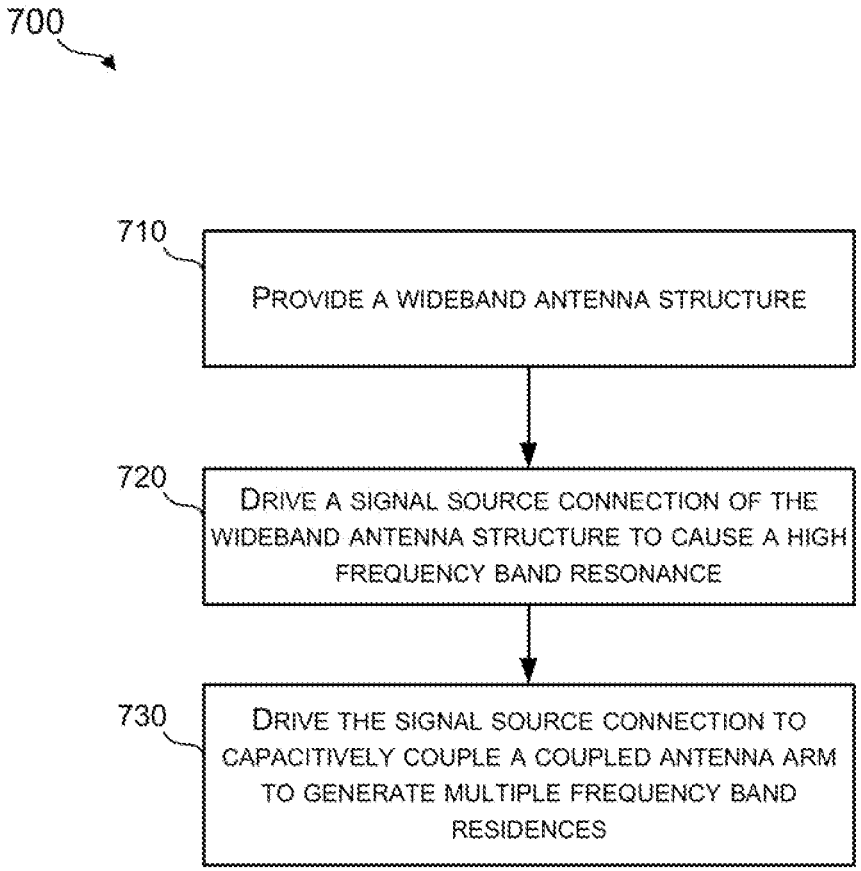
FIG. 7 is flowchart of an example method of driving a wideband antenna structure.

FIG. 7 depicts a flowchart of an example method 700 according to various implementations of the present disclosure. Each of the boxes depicted in FIG. 7 can represent operations performed by the processor 621 or any, other component of mobile computing device 600, such as an ASIC or wireless communication module (not shown). While the boxes of are depicted in a specific example order in FIG. 7, implementations of the present disclosure include preforming the operations of example method 700 in any serial or parallel order.

At box 710, a wideband antenna structure described herein can be provided. For example, a wideband antenna structure 100 can be provided in a mobile computing device 600.

At box 720, a processor 621 in mobile computing device 600 c n drive the signal source connection 110 of the wideband antenna structure 100 to cause a high frequency band resonance. In various implementations, driving the signal source connection 110 can include modulating electrical signals in accordance with a wireless data communication protocol, such as generations of global system for mobile communication (GSM 2/3G, 4G or long term evolution (LTE)), general packet radio services (GPRS), worldwide interoperability for microwave access (WiMAX), and the like, that use at least one frequency band of electromagnetic energy to communicate electronic voice and data signals wirelessly. As such, the term "high frequency band" can refer to at least one frequency band in a wireless data communication protocol that includes frequencies that are higher than frequencies included in another frequency band defined in the particular wireless data communication protocol.

At box 730, the processor 621 in mobile computing device 600 can drive the signal source connection 110 of the wideband antenna structure 100 to cause excitation antenna arm 112 to capacitively couple with the coupled antenna arm, including the PCB on a first side of the insulating material 140 and the antenna elements on a second side of the insulating material 140, to cause resonances in multiple frequency hands. For example, the multiple resonances can include resonances in frequency bands defined in a wireless data communication protocol that includes frequencies in the high frequency band and frequencies in other frequency bands defined in the particular wireless data communication protocol. The other frequency bands can include frequencies that are lower than the frequencies in the high frequency band. As such, the other frequency bands can be referred to as "low frequency bands".

In some implementations, driving the signal source connection 110 of the wideband antenna structure 100 can include generating signals that simultaneously or alternatingly cause the resonances in the high and low frequency bands. Also, as used herein, the term "drive" can mean applying a signal or detecting a signal. For example, wireless communication signals can be generated by the mobile computing device 600 cause multi-band resonances to transmit data communication signals. To receive data communication signals, the mobile computing device 600 can detect multi-band resonances to receive data communication signals. As such, the wideband antenna structure 100 can be used to transmit and receive wireless data communication signals using frequency bands defined in a corresponding wireless data communication protocol.

These and other variations, modifications, additions, and improvements may fall within the scope of the appended claims(s). As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise. All of the features disclosed in this specification (including any accompanying claims, abstract and drawings), and/or all of the elements of any method or process so disclosed, may be combined in any combination, except combinations where at least some of such features and/or elements are mutually exclusive.

What is claimed is:

1. An antenna comprising:

a planar conductive body disposed in a first plane;

a signal source connection disposed on the planar conductive body;

a direct feed antenna arm coupled to the signal source connection and disposed in a second plane parallel to the first plane, wherein the direct feed antenna arm comprises a monopole antenna arm disposed in the second plane and an orthogonal antenna element arm disposed in the second plane and orthogonal to the monopole antenna arm, wherein the monopole antenna arm and the orthogonal antenna element arm are disposed at a distal end from the signal source connection;

a coupled antenna arm disposed in the second plane and in proximity to a portion of the direct feed antenna arm; and a conductive interconnect element coupled to a region of the planar conductive body disposed in the first plane and the coupled antenna arm disposed in the second plane.

2. The antenna of claim 1 wherein the planar conductive body comprises a printed circuit board or a flexible printed circuit of a mobile computing device.

3. The antenna of claim 1 further comprising a data port assembly disposed on the planar conductive body.

4. The antenna of claim 3 wherein the data port assembly comprises a universal serial port connector.

5. The antenna of claim 1 further comprising an insulating material disposed between the first plane and the second plane.

6. The antenna of claim 1 wherein the first plane is coplanar with a first side of a printed circuit board and the second plane is coplanar with a second side of the circuit board.

7. The antenna of claim 1 wherein the direct feed antenna arm further comprises an excitation arm disposed in proximity to the coupled antenna arm on the second plane.

8. The antenna of claim 7 wherein the monopole antenna arm comprises:

a first antenna arm coupled to the signal source connection and disposed on and parallel to the first plane; and a second antenna arm coupled to the first antenna arm disposed between and perpendicular to the first plane and the second plane.

9. The antenna of claim 7 wherein the monopole antenna arm is dimensioned and positioned relative to the excitation arm and the signal source connection to cause high frequency band resonance.

10. The antenna of claim 7 wherein the excitation arm is dimensioned and positioned to capacitively couple with the coupled antenna arm to cause resonance in multiple frequency bands.

11. The antenna of claim 10 wherein the excitation arm is dimensioned and positioned to capacitively couple with the region of the planar conductive body to cause resonance in multiple frequency bands.

12. A method comprising:

providing a wideband antenna structure comprising:

a planar conductive body disposed in a first plane;

a signal source connection disposed on the planar conductive body;

a direct feed antenna arm coupled to the signal source connection arid disposed in a second plane parallel to the first plane, wherein the direct feed antenna arm comprises a monopole antenna arm disposed in the second plane and an orthogonal antenna element arm disposed in the second plane and orthogonal to the monopole antenna arm, wherein the monopole antenna arm and the orthogonal antenna element arm are disposed at a distal end from the signal source connection;

a coupled antenna arm disposed in the second plane and in proximity to a portion of the direct feed antenna arm; and a conductive interconnect element coupled to a region of the planar conductive body disposed in the first plane and the coupled antenna arm disposed in the second plane;

driving the signal source connection with a first electronic signal to cause a high frequency band resonance on at least a first portion of the direct feed antenna; and driving the signal source connection with a second electronic signal to capacitively couple a second portion of the direct feed antenna to the coupled antenna arm to cause resonances in multiple frequency bands.

13. The method of claim 12, wherein the first electronic signal is the second electronic signal.

14. A mobile computing device comprising a processor;

a printed circuit board coupled to the processor and comprising:

a first side;

a second side; and an insulating material disposed between the first side and the second side;

a signal source connection coupled to the first side;

a direct feed antenna arm disposed on the second side and coupled to the signal source connection, wherein the direct feed antenna arm comprises a monopole antenna arm disposed on the second side and an orthogonal antenna element arm disposed on the second side and orthogonal to the monopole antenna arm, wherein the monopole antenna arm and the orthogonal antenna element arm are disposed at a distal end from the signal source connection;

a coupled antenna comprising:

a first antenna arm disposed on the second side and in proximity to a portion of the direct feed antenna arm;

a second antenna arm disposed on the first side; and a conductive interconnect element coupled to the first antenna arm and the second antenna arm; and a memory comprising executable code, the executable code including instructions that when executed by the processor cause the processor to drive the signal source connection with an electronic signal to cause a high frequency band resonance on a first portion of the direct feed antenna and capacitively couple a second portion of the direct feed antenna to the coupled antenna arm to cause resonances in multiple frequency bands.

15. The mobile computing device of claim 14, wherein the instructions that cause the processor to drive the signal source connection further cause the processor to generate electronic communication signals in accordance with a dual band wireless communication protocol.

* * * * *